US005662578A

United States Patent [19]

Phelps

[11] Patent Number: 5,662,578

[45] Date of Patent: Sep. 2, 1997

[54] TAPE DISPENSER

[76] Inventor: David Y. Phelps, 2815 Stratford Ave., Louisville, Ky. 40205

[21] Appl. No.: 394,374

[22] Filed: May 26, 1995

[51] Int. Cl.[6] ..... B31B 49/00

[52] U.S. Cl. ..... 493/353

[58] Field of Search ..... 493/352, 353; 225/15, 14

[56] References Cited

U.S. PATENT DOCUMENTS

| | | | |
|---|---|---|---|
| 2,309,093 | 1/1943 | Borden | 493/352 |
| 4,104,110 | 8/1978 | Macosko | 156/523 |
| 4,437,854 | 3/1984 | Knoop | 493/353 |
| 4,540,393 | 9/1985 | Knoop | 493/353 |
| 4,576,674 | 3/1986 | Le Tarte | 156/463 |
| 4,634,415 | 1/1987 | Knoop | 493/353 |
| 4,664,306 | 5/1987 | Levy | 227/67 |
| 4,824,427 | 4/1989 | Smillie, III | 493/353 |
| 4,944,720 | 7/1990 | Suhr | 493/353 |
| 4,978,330 | 12/1990 | Suhr | 493/353 |

*Primary Examiner*—Joseph J. Hail, III
*Assistant Examiner*—Darren Ark
*Attorney, Agent, or Firm*—Don Halgren

[57] ABSTRACT

The present invention involves a tape dispenser which automatically generates non-sticky segments at the end or tab of tape or at successive segments of tape being pulled therefrom. This is accomplished by a media dispenser which deactivates the adhesive or by a roll member which creates a fold on the distal end of the tape, to provide the user non-sticky segments or end thereon.

10 Claims, 3 Drawing Sheets

TAPE DISPENSER

BACKGROUND OF THE INVENTION (1) Field of the Invention

This invention relates to tape dispensers, and more particularly to adhesive tape dispensing machines for rendering a portion of the tape dispensed non-sticky.

(2) Prior Art

Tape dispensers have been known for many years in the fields of business, art, packaging, and medicine. In each of these tape dispensing arrangements, typically only the first piece of tape from a roll, has a tab on the end thereof which is non-sticky, to permit the user to grip and start the roll without struggling to find and free the end of the roll of tape.

In many particular fields, however, tape is often removed from the object in which it has been placed, such as the field of painting houses or automobiles. The ability to modify that tape to facilitate its easy removal has yet to be properly accomplished. Another particular field needing that ability is the field of medicine.

The tape in the medical field is utilized to hold medical devices or appliances on to a patient's body, or to act as a bandage. The ability to remove that tape requires the medical practitioner to first loosen one end from the patient's skin. This may be sensitive, an irritant, or dangerous, as it may cause an infection, tear the skin, or just be very difficult to remove by virtue of being unable to pull up on a corner or end thereof.

It is therefore an object of the present invention, to provide a tape dispenser which delivers each successive strip of tape with a gripping tab portion which does not have an exposed adhesive thereon.

It is a further object of the present invention to provide a tape dispenser which may be utilized to automatically cut the tape at the desired location and always present the user with at least one tab without an aggressive adhesive piece on that tape.

It is yet a further object of the present invention to provide a tape which has a non-sticky gripping end to minimize contamination therewith, thus allowing a more sterile way of applying tape.

BRIEF SUMMARY OF THE INVENTION

The present invention comprises a hand actuatable tape dispensing unit having an elongated housing. The housing has a first end which internally rotatably supports the roll of adhesive tape. The roll of adhesive tape is supported on an axis which extends between two halves of the housing. The housing comprises a container which encloses the roll of adhesive tape except at the second end, where the adhesive tape may be grasped and pulled from the housing. The tape dispenser also include a pivotable platen which is attached at its proximal end about an axis which extends between a mid-point of the two halves of the housing. The platen has a distal end which extends into the second end of the housing, having a projection thereon which extends at an approximately 90 degree angle with respect to the plane of the platen. The platen has a downwardly extending finger disposed at an acute angle, proximal with respect to the plane of the platen. The angularity disposed finger has a distal end with a universal hub thereon. The platen has a central opening disposed through its distal most planer portion of rectangular configuration. A plurality of gear tooth like projections is arranged on the upper planer surface of the platen, transversely transposed with respect to the longitude and the axis of the platen.

A flexible arm extending from the base of the housing, extends up through the opening in the platen, the arm having a bifurcation at its distal end. The bifurcated arm is flexible. A bearing is arranged at each end of the bifurcation. A roll member, of cylindrical configuration is disposed between the two bearing members on the distal end of the bifurcation's. The bifurcation's support, in a rotative manner, the roll between those bearing support. The roll comprises a cylindrical surface, on each end of which, a spur gear is formed. An axle extends through the cylindrical member and through the spur gear forms, to engage the bearings on the end of the bifurcated arm. The gear forms at each end of the cylindrical surface have a plurality of teeth which engage the tooth-like grooves on the planar surface of the platen. A pivot finger is arranged between the distal-most end of the angularly extending finger extending downwardly from the distal end of the platen. The pivot finger has a central hub, which engages a portion of the inner wall of the housing. The pivot finger has a first end which is angularly formed at an angle of about 135 degrees from the longitudal axis of the pivot finger. A footpad is disposed on the first end of the elongated finger. The elongated finger has a second end which is in articulately engagement with the universal hub on the distal end of the angularly disposed finger extending downwardly from the distal end of the platen.

In operation of the tape dispensing device of the present invention, the roll of tape, supported about its axis on the first end of the housing, has a loose end thereof which extends down toward the opening, the distal end of the tape being disposed between the footpad of the articulable finger, and an inner lip of the housing, adjacent the opening at its second end. The tape extends outwardly, having an adhesive surface which extends onto the surface of the cylindrical member.

In its initial function, the flexible arm which carries the rotatable cylindrical member, is disposed at the midpoint of the platen at the first end of the gear tooth projections thereon. A fold at that point, is made in the tape as it extends just beyond the lip of the housing. The user grasps that folded portion of the tape so as to have adhesive surface against adhesive surface thereof to form a tab at the distal end of the tape. By grasping the tab and pulling outwardly on the tape, off of the roll, fresh adhesive tape is pulled against the surface of the cylindrical member. As the adhesive tape is drawn across the periphery of the cylindrical member, the gear teeth on the ends of the axle supporting the cylindrical member are caused to engage the gear tooth formation on the upper surface of the platen. This causes an arcuate motion in the distal end of the flexible arm which arm extends from the base of the housing, and which pivotal motion causes the platen to pivot slightly towards the base of the housing. As the tape is being pulled from the dispenser, the cylindrical member is caused to rotate and travel to the end of the rack of teeth in the platen.

A serrated knife edge is disposed on the distalmost edge of the second end of the housing, against which the tape being pulled, and which may be pressed against. By pulling downwardly to tear the tape across the serrated edge, the tape thus puts a bias against the distalmost upwardly edge of the platen. This bias pushes against the downwardly extending angularly disposed finger which engages the pivotable finger at its distal end. The pivotable finger having its footpad at its first end, thus is caused to pivot about its pivot axis so as to clamp the adhesive tape between the footpad and the edge of the housing at the opening.

Once the tape is cut, the force pulling downwardly on the distal end of the platen is removed, and the cylindrical member is permitted to roll back toward its initial position at the beginning of the gear tooth rack arrangement at the mid-point of the platen by virtue of the spring force within the flexed arm extending from the base of the housing. As the cylindrical member rolls backwardly, the foot pad is caused to pivot downwardly with the adhesive holding the tape thereon. The relative motion between the footpad and the cylindrical member returning towards initial position, causes the tape stuck thereto, to create a fold by which the next user may thus form a new tab at the distal end of the tape.

A further embodiment of the present invention comprises a hand actuatable tape dispensing unit having an elongated housing with a roll of tape rotatably secure at one end thereof. The housing comprises a forward half having a distal end and a proximal end. The proximal end is attached to and pivots on an axis. The axis also supports the roll of tape thereon.

An "L" shaped finger extendible with and contiguous from the forward half of the housing, extends diametrically across the support axis of the adhesive tape roll.

The housing also includes a rear half housing. The rear half housing has a distal end and a proximal end. The proximal end of the rear half housing supports the axis of rotation of the tape roll, in a rotative relationship therebetween.

The forward half housing and the rearward half housings are biased apart by a compressive spring which is disposed across the two half housings at mid-points thereof. The rear half housing also supports a forward projecting arm having a distal most end spaced from the axis of rotation of the tape support axis. An applicator roll is rotatably supported at the distalmost end of the applicator arm. The applicator roll has an axis extending there through which holds that roll in rotatable disposition therewith. A pulley is disposed on the support axis of the tape roll. A second pulley is disposed on the axis of rotation of the applicator roll. A drive belt extends around each of the pulleys between the axis of the tape roll and the application roll.

The support arm has a media reservoir adjacent to and in communication with the application roll at the distal end of the forward extending arm. The media may be comprised of a dust or adhesive dissolving fluid, or a germicidal or funguscidal preparation which rubs onto the applicator roll, as that applicator roll rotates.

The distal end of the elongated "L" shaped finger, has a curvilinear tip with an outermost surface which corresponds to the angular outer surface of the applicator roll. A sharp linear knife like edge extends across the distal most tip of the finger, so as to provide a cutting edge thereat.

The roll of tape, has an unwound portion extending off of its edge, and extends adjacent to the underside of the extended "L" shaped finger bar. The tape extends through a slot adjacent to the curvilinear edge of the distal end of the finger.

In operation of the present alternative embodiment of the tape dispenser device, the forward half housing and the rearward half housing are squeezed together against the compressive spring disposed there between. Movement of the forward half housing with respect to the rearward half housing causes the forward half housing to pivot about the support axis of the roll of tape. As the forward half housing pivots about the support axis, the "L" shaped elongated finger, pivots about the support axis as well. As the "L" shaped support finger pivots, its distal most end is brought into pressurized contact with the application roll. A strip of tape, however, disposed adjacent to the elongated "L" shaped finger, is arranged between the distal most end of the "L" shaped lever, and the applicator roll. As the distal most end of the finger and the applicator roll are pressed against one another, the tape there between, gets an application of media which has been transferred to the applicator roll to the adhesive on the tape. The sharp end of the distal most tip of the elongated "L" shaped finger provides a cutting edge for the distal end of the tape. The user merely lifts up on the tape to provide the cutting of the tape at the desired location.

Release of the forward half of the housing, will cause the forward half of the housing and the rearward half of the housing to be pushed apart, due to the action of the compressive spring there between. This same rotary motion, pushing the forward half and the rearward half of the housing apart, acts to pivot the elongated "L" shaped finger upwardly away from the forwardly directed arm and the applicator roll. Thus a fresh piece of tape, with at least one end having a tab or an application of media thereon, to negate any adhesive on that portion of the tape which was pressed against the applicator roll, is presented to the user.

Thus a user may again grasp the distal end of the tape hanging between the distal end of the elongated "L" shaped arm and the applicator roll, and pull it to what ever length it desired. Upon squeezing of the forward half of the housing to the rear half of the housing thus completes the cycle once again, to again bring the elongated "L" shaped finger against the applicator roll to create a new tab and to permit the now pulled away piece of tape to be cut by the knife blade of the distal end of the arm.

Thus what has been shown as a novel and unique tape dispensing device, which permits a user to grasp an end of a piece of tape, that end of tape being non-sticky, because of an application of media such as powder or disinfectant or fluid, to remove the adhesive therefrom. That user may pull that tab to what ever length desired so as to permit the tape to be severed and a new tab formed.

BRIEF DESCRIPTION OF THE DRAWINGS

The objects and advantages of the present invention will become more apparent, when viewed in conjunction with the following drawings, in which.

DESCRIPTION OF THE PREFERRED EMBODIMENTS

Figure 5:
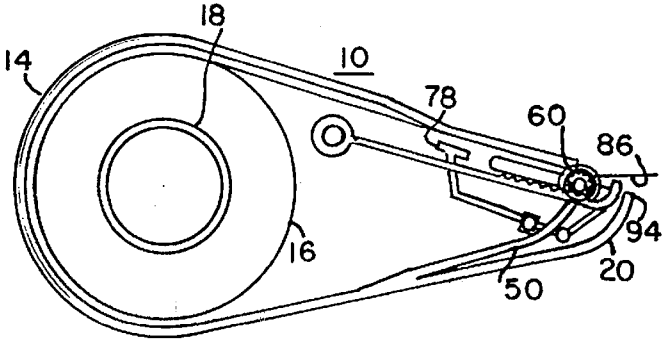
Figure 6:
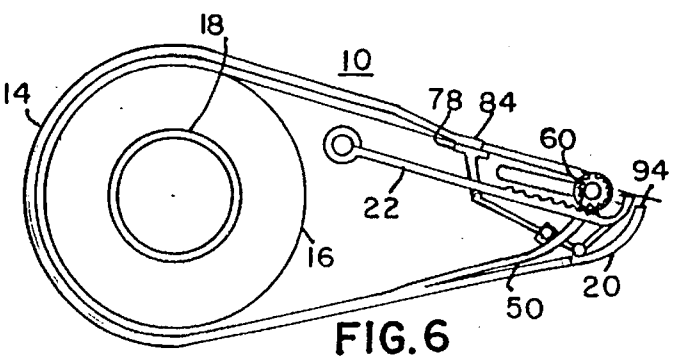
Figure 7:
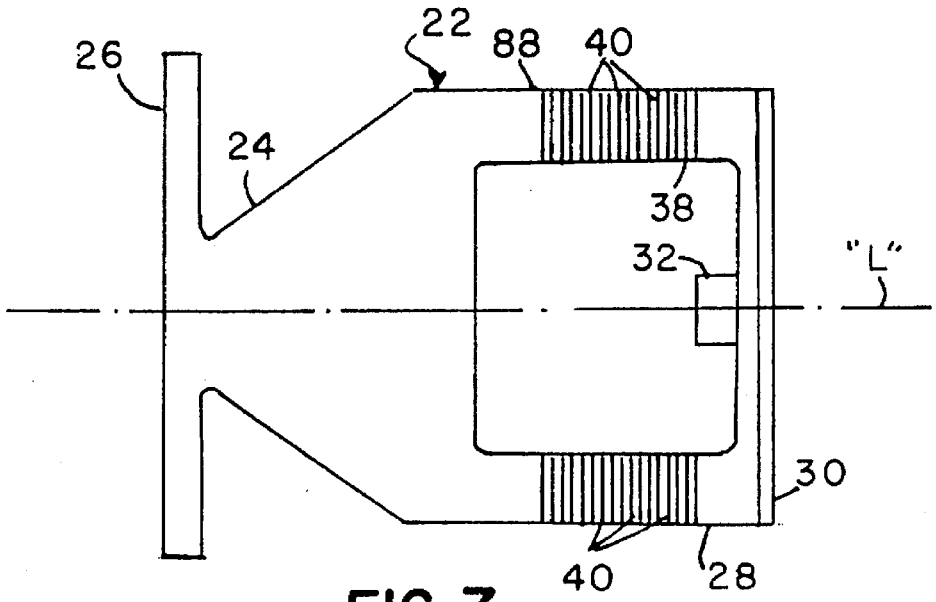
FIG. 7 is a plane view of a platen of the tape dispensing device shown in FIGS. 1–6.
Figure 8:
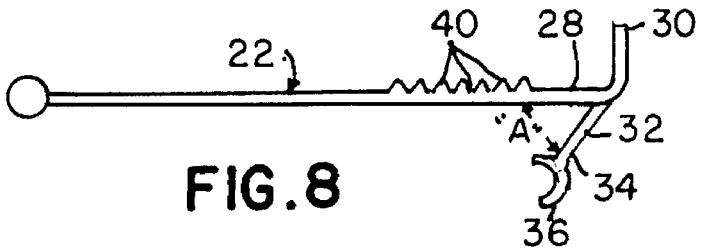
FIG. 8 is a view taken along the lines VIII—VIII of FIG. 7.

The present invention comprises a hand actuatable tape dispensing unit 10 having a support such as an elongated housing 12, as shown in the sequentially arranged FIGS. 1 through 6. The housing 12 has a first end 14 which internally rotatably supports the roll of adhesive tape 16. The roll of adhesive tape 16 is supported on an axis 18 which extends between two longitudinally divided halves of the housing 12, only one half 17 being shown for clarity of viewing. The housing 12 comprises a support or container which encloses the roll of adhesive tape 16 except at the second end 20, where the adhesive tape may be grasped and pulled from the housing 12. The tape dispenser 10 also includes a pivotable platen 22, as also shown in FIGS. 7 and 8, which platen 22 is attached at its proximal end 24 about an axis 26 which extends between a midpoint of the two halves of the housing 12. The platen 22 has a distal end 28 which extends to the second end 20 of the housing 12, having a short lip-like projection 30 thereon which extends at an approximately 90 degree angle with respect to the plane of the platen 22. The platen 22 has an oppositely disposed downwardly extending finger 32 disposed at an acute angle "A" proximally, with respect to the plane of the platen 22, as shown in FIG. 8. The angularly disposed finger 32 has a distal end 34 with a universal hub 36 thereon. The platen 22 has a central opening 38 disposed through its distalmost planer portion 28 and is of rectangular configuration. An engagement means such as a plurality of gear tooth like projections 40 are arranged on the upper planer surface of the platen 22, transversely disposed with respect to the longitudinal axis "L" of the platen 22, as shown in FIG. 7.

Figure 9:
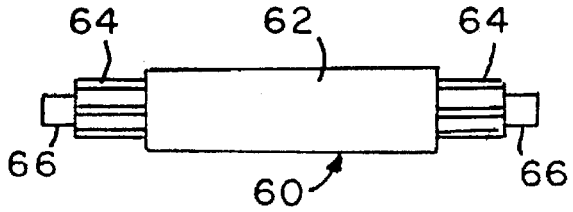
FIG. 9 is a plane view of a cylindrical member utilized in the tape dispensing device of FIG. 1.

A tape strip engaging means, comprising a flexible arm 50 extends from the base 52 of the housing 12, extends up through the opening 38 in the platen 22, the arm 50 being of "Y" configuration, having a pair of arms 51, only one being shown, each arm 51 having a bearing journal, not shown, at its distal end 54. A roll member 60, of cylindrical configuration, as may be seen in FIG. 9, is disposed between the two bearing members on the distal end 54 of the flexible arm 50. The bearing journals support, in a rotative manner, the roll 60 between those bearing supports. The roll 60 comprises a cylindrical surface 62, on each end of which, a spur gear 64 is formed. An axis 66 extends through the cylindrical member 60 and through the spur gears 64, to engage the bearing journals on the end of the flexible "Y" shaped (bifurcated) arm 50 at each longitudinal side of the platen 22. The gears 64 at each end of the cylindrical surface 62 comprise a plurality of teeth which engage the tooth like grooves 40 on the planar surface of the platen 22, as shown in FIGS. 1 through 7.

Figure 2:
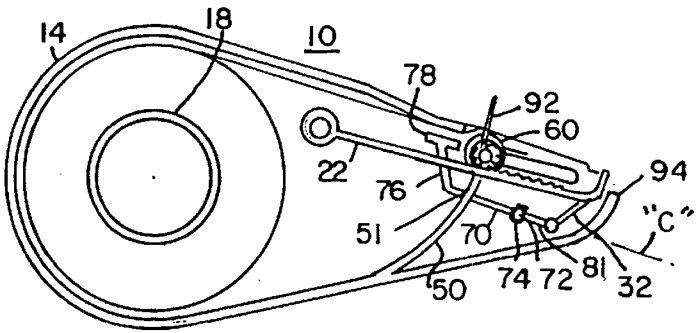
FIGS. 2–6 are views similar to that of FIG. 1, showing the steps in the functioning and operation of the tape dispenser unit shown in FIG. 1.
Figure 3:
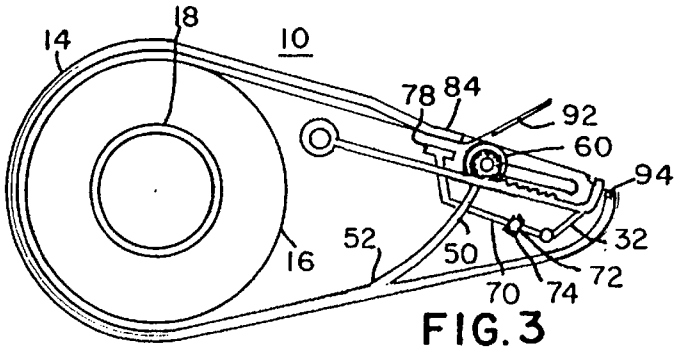
Figure 4:
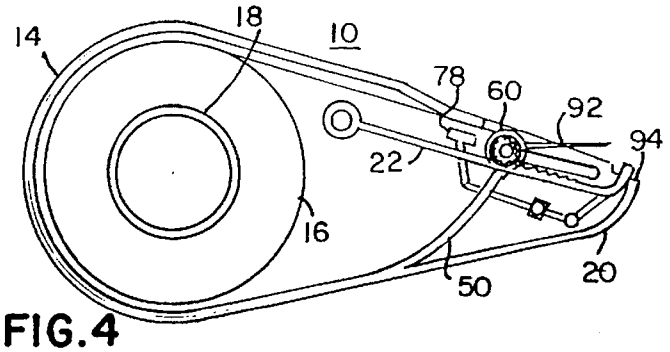

A relatively rigid pivot finger 70 is arranged between the distalmost end 34 of the angularly extending finger 32 extending downwardly from the distal end 28 of the platen 22. The pivot finger 70 has a central hub 72, which pivotally engages a pivot portion 74 of the inner wall 75 of the housing 12. The pivot finger 70 has a first end 79 which is angularly formed at an angle "B" of about 135 degrees, from the longitudinal axis "C" of the pivot finger 70, as shown in FIG. 2. A footpad 78 is disposed on the first end 79 of the elongated finger 70. The elongated finger 70 has a second end 81 which is in articulable engagement with the universal hub 36 on the distal end 34 of the angularly disposed finger 32 extending downwardly from the distal end 28 of the platen 22. The first end 79 of the finger extends through the opening 38 of the platen 22.

In operation of the tape dispensing device 10 of the present invention, the roll of tape 16, supported about its axis 18 on the first end of the housing 12, has a pullable end 80 which extends down toward the opening, the distal end of the tape being disposed between the footpad 78 of the articulable finger 70, and an inner lip 84 of the housing 12, adjacent the opening at its second end 20. The tape 80 extends outwardly from the housing 12, having one side with an adhesive surface 86 which extends onto the surface 62 of the cylindrical member 60.

Figure 1:
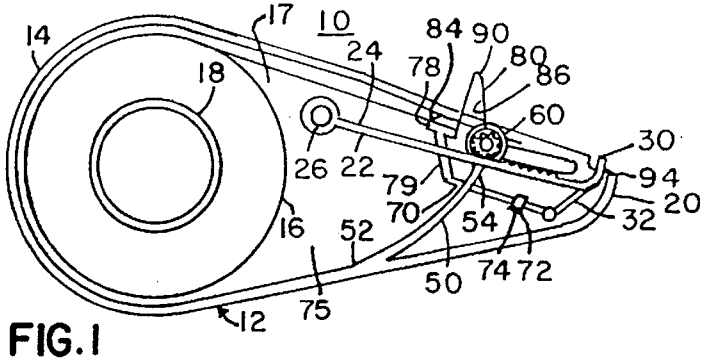
FIG. 1 is a side elevational view, in section, showing a tape dispensing unit constructed according to the principals of the present invention.

In its initial function, the flexible arm 50 which carries the rotatable cylindrical member 60 is disposed at the midpoint of the platen 22 at the first end 88 of the gear tooth projections 40, thereon, as shown in FIG. 1. A fold 90 at that point, is made in the tape as it extends just beyond the lip 84 of the housing 12. The user grasps that folded portion of the tape so as to have adhesive surface 86 against adhesive surface 86 thereof to form a tab 92 near or at the distal end of the tape 80. By grasping the tab 92 and pulling outwardly on the tape, from the roll 16, fresh adhesive tape is pulled against the surface 62 of the cylindrical member 60. As the adhesive tape 80 is drawn across the cylindrical periphery of the cylindrical member 60, the gear teeth 64 on the cylindrical member 60 are caused to engage the gear tooth 40 formation on the top surface of the platen 22. This causes an arcuate motion in the distal end 54 of the flexible arm 50 which extends from the base 52 of the housing 12 and biasedly causes the platen 22 to pivot slightly towards the base 52 of the housing 12, as shown most clearly in FIGS. 3 through 6. As the tape is being pulled from the dispenser 12, the cylindrical member 60 is caused to rotate and travel to the end of the rack of teeth 40 in the platen 22, as shown in FIG. 5.

A serrated knife edge 94 is disposed on the distalmost edge of the second end 20 of the housing 12, against which the tape 80 being pulled, may be pulled against. By pulling downwardly to tear the withdrawn tape across the serrated edge, the tape thus puts a bias against the distalmost upwardly directed edge 30 of the platen 22. This bias force also pushes against the downwardly extending angularly disposed finger 32 which engages the pivotable finger 70 at its distal end 34. The pivotable finger 70 having its footpad 78 at its first end 79, is thus caused to pivot about its pivot axis 74 so as to clamp the adhesive tape 80 between the footpad 78 and the lip 84 of the housing 12 at its opening, as shown in FIG. 6.

Once the tape 80 is cut, the force pulling downwardly on the distal end 28 of the platen 22 is removed, and the cylindrical member 60 is permitted to roll back toward its initial position at the beginning 88 of the gear tooth rack 40 arranged at the mid-point of the platen 22 by virtue of the spring force within the flexable arm 50 extending from the base 52 of the housing 12. As the cylindrical member 60 rolls backwardly, the footpad 78 is caused to pivot downwardly with the adhesive 86 holding the tape thereon. The relative motion between the footpad 78 and the cylindrical member 60 returning towards initial position, causes the tape to become unstuck therefrom, to create a fold 90 (as shown in FIG. 1), by which the next user may thus form a new tab 92 at the distal end of the tape 80. If the user desires not to tear off the tape, but wishes to make a series of tabs, the user need only not bring the tape against the actual blade 94, and allow the cylinder 60 to roll back and form another tab 92.

It is to be noted that actuation of the dispenser unit 10 may be accomplished by hand or foot actuation (with proper linkages) or by automatic means.

Since the tape need not be severed after only one tab is placed thereon or after one segment of adhesive is neutralized or made less aggressive, it may be made with a series of tabs or non-sticky segments as needed by merely avoiding the serrations and continuing to pull the tape off of the roll while actuating the tab/neutralizing mechanism.

Figure 10:
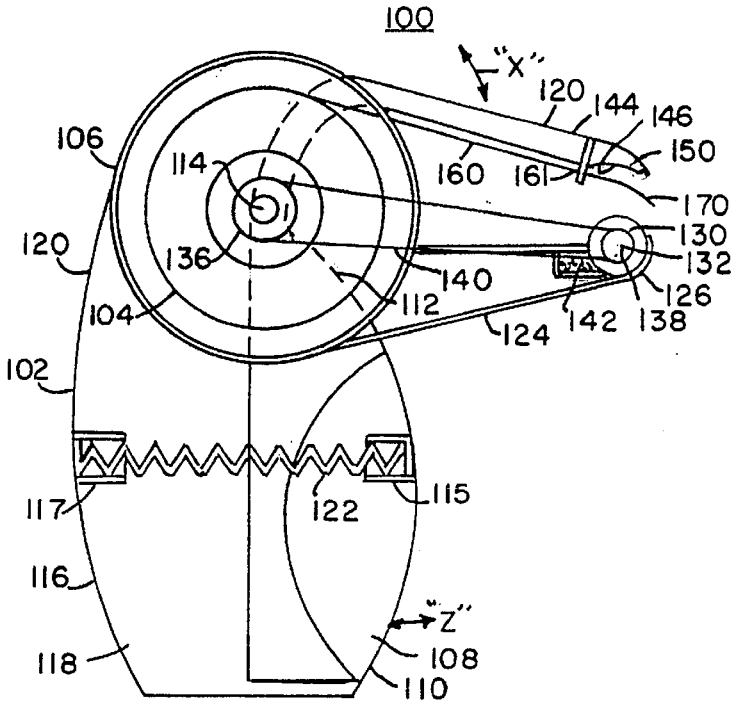
FIG. 10 is a side elevational view, in section, showing a tape dispenser constructed according to the principals of the present invention.
Figure 11:
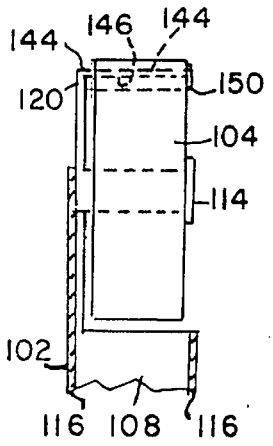
FIG. 11 is a side elevational view taken along the lines XI—XI of FIG. 10.
Figure 12:
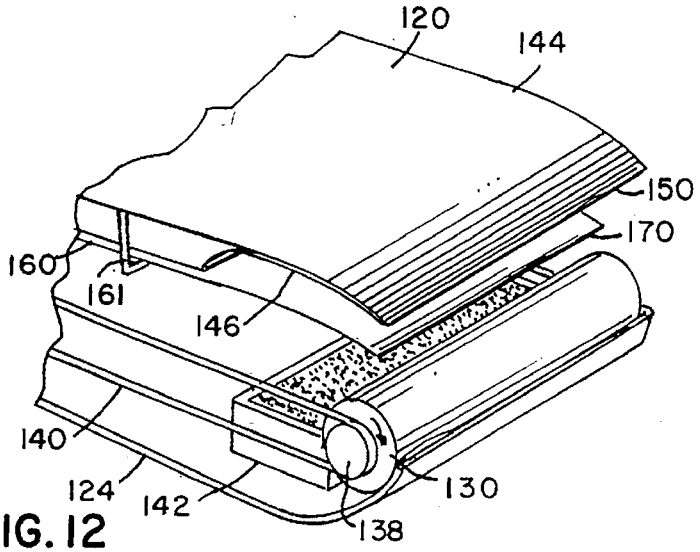
FIG. 12 is an enlarged perspective view of the cutting and applicator mechanism of the present invention.

An alternative embodiment of the present invention comprises a hand actuatable tape dispensing unit 100, as shown in FIG. 10, having a support such as an elongated housing 102 with a roll of tape 104 rotatably secure at a first end 106 thereof. The housing 102 comprises a forward half 108 having a distal end 110 and a proximal end 112. The proximal end 112 is attached to and pivots on an axis 114. The axis 114 also supports the roll of tape 104 thereon. An "L" shaped finger 120 extendible with and contiguous from the proximal end 112 of the forward half 108 of the housing 102, extends diametrically across the support axis 114 of the adhesive tape roll 104.

The housing 102 also includes a rear half housing 116. The rear half housing 116 has a distal end 118 and a proximal end 120. The proximal end 120 of the rear half housing 116 supports the axis 114 of rotation of the tape roll 104, in a rotative relationship therebetween, as shown in FIG. 10.

The forward half housing 108 and the rearward half housing 116 are biased apart by a compressive spring 122 which is disposed across the two half housings 108 and 116 and are secured in sockets 115 and 117 at mid points thereof. The rear half housing 116 also supports a forward projecting support arm 124 having a distalmost end 126 spaced from the axis of rotation of the tape support axis 114. An applicator roll 130 is rotatably supported at the distalmost end of the forward projecting support arm 124. The applicator roll 130 has an axis 132 extending therethrough which holds that roll 130 in rotatable disposition therewith. A pulley 136 is disposed on the support axis 114 of the tape roll 104. A second pulley 138 is disposed on the axis 132 of rotation of the applicator roll 130. A drive belt 140 extends around each of the pulleys 136 and 138 between the axis 114 of the tape roll 104 and the application roll 130.

The support arm 124 has a media reservoir 142 adjacent to and in communication with the application roll 130 at the distal end of the forward extending support arm 124. The media in the reservoir in this embodiment, may be comprised of a dust or adhesive dissolving fluid, or a germicidal or funguscidal preparation which rubs onto the cylindrical surface of the applicator roll 130, as that applicator roll 130 rotates on its axis.

The distal end of the elongated "L" shaped finger 120, which extends out of the proximal end of the first end 106, has a curvilinear tip 144 with an inwardly directed curved surface 146, which corresponds to the angular cylindrical outer surface of the applicator roll 130. A sharp linear knife like edge 150 extends across the distal most tip of the finger 120, so as to provide a cutting edge thereat.

The roll of tape 104, with an adhesive laden "inner" side, has an unwound portion 160 extending off of its edge, and extends adjacent to the underside of the extended "L" shaped finger bar 120. The tape 160 may extend through a support slot 161 arranged on the finger 120 adjacent the tip 144 and between the curvilinear tip 144 of the distal end of the finger 120 and the support arm 124.

In operation of the alternative embodiment of the tape dispenser device, the forward half housing 108 and the rearward half housing 116 are squeezed together against the compressive spring 122 disposed therebetween. Movement of the forward half housing 108 with respect to the rearward half housing 116 causes the forward half housing 108 to pivot about the support axis 114 of the roll of tape 104. As the forward half housing 108 pivots about the support axis 114, the "L" shaped elongated finger 120 pivots about the support axis 114 as well. Arrows "X" and "Z" designate such motion. As the "L" shaped support finger 120 pivots, its distalmost end is brought into pressurized contact with the application roll 130. A strip of tape, however, disposed adjacent to the elongated "L" shaped finger 120, is arranged between the distalmost end of the "L" shaped finger 120 and the applicator roll 130. As the distalmost curvilinear end 146 of the finger 120 and the applicator roll 130 are pressed against one another, the sticky side of the tape 160 therebetween, gets an application of media which has been transferred to the applicator roll 130 then to the adhesive on the tape 160. The sharp end 150 of the distalmost tip of the elongated "L" shaped finger 120 may provide a cutting edge for the distal end of the tape. The user may merely lift up on the tape to provide the cutting of the tape at the desired location, or pull out more tape off of the roll and create further spaced-apart adhesive-neutralized portions thereon.

Release of the forward half of the housing 108 will cause the forward half of the housing 108 and the rearward half 116 of the housing to be pushed apart, due to the action of the compressive spring 122 therebetween. This same rotary motion, pushing the forward half 108 and the rearward half 116 of the housing apart, acts to pivot the elongated "L" shaped finger 120 upwardly away from the forwardly directed arm and the applicator roll 130. Thus a fresh piece of tape, with a neutralized segment or tab 170, having an application of media thereon to negate any adhesive on that portion of the tape which was pressed against the applicator roll, is thus presented to the user.

Thus a user may again grasp the distal end of the tape hanging between the distal end of the elongated "L" shaped finger 120 and the applicator roll 130, and pull it to whatever length is desired. Upon squeezing of the forward half 108 of the housing 118 to the rear half 116 of the housing 118 thus completes the cycle once again, to again bring the elongated "L" shaped finger 120 against the applicator roll 130 to create a new tab 170 and to permit the now pulled-away piece of tape 160 to be cut by the knife blade 150 of the distal end of the finger 120.

Thus what has been shown is a novel and unique tape dispensing device, which permits a user to grasp an end of a piece of tape, that end of tape being non-sticky, because of an application of tape to itself or by the application of a media such as a talcum powder or disinfectant or fluid, to remove, neutralize or inactivate the adhesive thereon. Such conditioning of segments of tape pulled from a supply roll in the media reservoir may be accomplished by a roll or stack of reservoir coupons made of plastic or paper which are caused to adhere to the desired segment of the tape which the user wishes to make non-sticky. The selective removal or incapacitating of the adhesive on the tape may also be accomplished where the reservoir dispenses adhesive deactivating heat, pressure, moisture/fliud, or electromagnetic waves such as UV light or RF radiation through a proper source. Thus with such means for neutralizing end or one or more mid portion adhesive segments on a length of tape, that user may pull that tape to what ever length desired so as to permit the tape to be severed and a new tape with a new tab(s) formed, or with numerous non-sticky segments arranged therealong.

I claim:

1. An adhesive tape dispensing unit for the dispensing of successive strips of adhesive tape, each strip having at least one non-sticky section thereon for the non-adhesive utilization thereof, comprising:

a tape dispensing support;

a roll of adhesive tape arranged in said support; and a movable pad and a movable cylindrical member cooperatively arranged with respect to one another in said tape dispenser support, to form a graspable tab on said strip of tape as said pad and said cylindrical member pivot towards one another, with a portion of said tape attached between them;

said movable pad arranged on a pivot to move into tape pinching engagement with said dispenser support as said cylindrical member moves with respect to said pad so as to form a fold of tape to create the non-adhesive gripping tab at the distal end of said tape; wherein said cylindrical member is supported by a flexible arm having a proximal end which is attached to a base of said support.

2. The adhesive tape dispensing unit as recited in claim 1, wherein said movable pad is arranged to move into tape pinching engagement with said dispenser support as said cylindrical member moves towards said pad, so as to form a fold of tape to create a non-adhesive gripping tab at the distal end of said tape.

3. An adhesive tape dispensing unit as recited in claim 2, wherein said cylindrical member is movable along a platen when a section of tape is pulled across said cylindrical member.

4. An adhesive tape dispensing unit as recited in claim 3, wherein said pad is arranged on the distal end of a pivotable finger, and moves when said section of tape effects a bias thereon.

5. An adhesive tape dispensing unit as recited in claim 1, wherein said flexible arm pivots about said proximal end in response to a tape segment being pulled from said dispensing unit.

6. An adhesive tape dispensing unit as recited in claim 1, wherein said cylindrical member has a gear arranged on each end thereof.

7. An adhesive tape dispensing unit as recited in claim 6, wherein an elongated platen is pivotably attached to said support at a proximal end thereof, said platen having an opening through which said flexible arm extends, said platen having a rack arrangement which engages said gears on the ends of said cylindrical member.

8. The adhesive tape dispensing unit as recited of claim 1, wherein said adhesive tape is folded upon itself at spaced apart locations to provide a plurality of the non-adhesive gripping tabs by which a user may grip said adhesive tape without contamination thereof.

9. The adhesive tape dispenser as recited in claim 1, wherein said movable pad and said cylindrical member are effected to form said non-adhesive gripping tab as said adhesive tape is being withdrawn.

10. The adhesive tape dispenser as recited in claim 9, wherein said non-adhesive gripping tab comprises a folded tab thereon.

* * * * *